US005961403A

United States Patent [19]

Caruso

[11] Patent Number: 5,961,403

[45] Date of Patent: Oct. 5, 1999

[54] TRAINING DEVICE FOR SOCCER

[76] Inventor: Anthony Caruso, Kwick Goal Ltd., 140 Pacific Dr., Quakertown, Pa. 18951

[21] Appl. No.: 09/039,930

[22] Filed: Mar. 16, 1998

[51] Int. Cl.[6] ..... A63B 69/00

[52] U.S. Cl. ..... 473/446; 473/411

[58] Field of Search ..... 473/446, 410, 473/411

[56] References Cited

U.S. PATENT DOCUMENTS

| | | | |
|---|---|---|---|
| 2,657,056 | 10/1953 | Sorteberg | 473/410 |
| 4,700,952 | 10/1987 | Patsy | 273/369 |
| 4,720,095 | 1/1988 | Sowards | 272/77 |
| 4,948,147 | 8/1990 | Pallanca | 273/402 |
| 5,048,844 | 9/1991 | Haseltine | 273/400 |
| 5,358,258 | 10/1994 | Killion | 273/414 |

*Primary Examiner*—William H. Grieb
*Attorney, Agent, or Firm*—Richard L. Miller

[57] ABSTRACT

A training device for soccer for placement on a field and for allowing a soccer ball to be rebounded thereoff, kicked therethrough, and played therearound by a soccer player. The device includes a pair of identical supports for placement on a field and a plurality of planks that extend between the pair of supports. The pair of identical supports are inverted U-shaped. The plurality of planks include a plurality of top planks that extend longitudinally from one support to the other support, at their tops. The plurality of top planks are affixed to each support by top carriage bolts that depend through each top plank, through a respective support, and through top washers and threadably engage top nuts, with the plurality of top planks completely closing the training device for soccer, at its top. The plurality of planks further include a plurality of side planks that extend longitudinally from one support to the other support, at their sides. The plurality of side planks are affixed to each support by side carriage bolts that pass laterally through each side plank, through the respective support, and through side washers and threadably engage side nuts, with the plurality of side planks completely closing the training device for soccer, at both its sides, while leaving the training device for soccer completely open at its front, rear, and bottom.

3 Claims, 2 Drawing Sheets

TRAINING DEVICE FOR SOCCER

BACKGROUND OF THE INVENTION

1. Field of the Invention

The present invention relates to a training device. More particularly, the present invention relates to a training device for soccer.

2. Description of the Prior Art

Numerous innovations for soccer training devices have been provided in the prior art that will be described. Even though these innovations may be suitable for the specific individual purposes to which they address, however, they differ from the present invention.

FOR EXAMPLE, U.S. Pat. No. 4,700,952 to Patsy teaches a moving target for practicing perceptual and perceptual motor skills particularly for education, therapy, athletics and amusement. The moving target may be large or small at ground level and may be propelled at various different speeds in opposite directions. The interval of movement in a given direction is available selectively or randomly as is the pause time between intervals of movement and speed. The movement of the target permits the practice for training and increasing motor skills, adaptability and attentiveness to time, distance, direction and force at all levels of skill.

ANOTHER EXAMPLE, U.S. Pat. No. 4,720,095 to Sowards teaches a soccer training and practice device comprising a ball-like target mounted to an anchor member for engaging the ground. The anchor member is preferably a helical coil that can be twisted into the ground. The ball-like target is mounted to the anchor member so that when the anchor member is anchored in the ground the ball is in position where it can be kicked by a person standing on the ground. The mounting means allowing the target to move but retaining the target in substantially its original position where it can be repeatedly kicked.

STILL ANOTHER EXAMPLE, U.S. Pat. No. 4,948,147 to Pallanca teaches training devices for playing various ball games and, more particularly, to a new target for making training easier for players in sports such as soccer and the like, in which a ball is kicked or otherwise shot toward a net.

YET ANOTHER EXAMPLE, U.S. Pat. No. 5,048,844 to Haseltine teaches a soccer goal practice device having a frame and a net extending with the frame. The frame has first and second upstanding side members and a cross member extending between, and connected to the top ends of, the side members. The net is formed as a lattice having a perimeter corresponding substantially in shape and size to the frame. The net includes a rugged perimeter cord along the perimeter of the net, and the perimeter cord has a length shorter than that of the perimeter of the net. The perimeter cord is fastened to the frame such that the net extends between the side members and the cross member. Due to the reduced perimeter of the perimeter cord, the net will include a slight blouse when extending over the frame. This blouse causes ground balls entering the net to be rebounded with an upward velocity component, such that rebounded ground balls bounce. This provides a more challenging and realistic return of the ball to the user. The frame is modular such that the entire device may be easily assembled, disassembled and transported.

FINALLY, STILL YET ANOTHER EXAMPLE, U.S. Pat. No. 5,358,258 to Killion teaches a soccer training device that attaches a soccer ball to a user through a flexible tether line. An adjustable belt encircles the waist of the user and attaches to one end of the elastic tether line. The other end of the tether line is attached to a girdle made of elastic sheet material that encircle the soccer ball. Certain features of the girdle allow it to hold the ball firmly while, simultaneously, provide proper tactile feedback to the user when kicking the ball. Several novel soccer training exercises useful with the present invention are described.

It is apparent that numerous innovations for soccer training devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a training device for soccer that avoids the disadvantages of the prior art.

ANOTHER OBJECT of the present invention is to provide a training device for soccer that is simple and inexpensive to manufacture.

STILL ANOTHER OBJECT of the present invention is to provide a training device for soccer that is simple to use.

BRIEFLY STATED, YET ANOTHER OBJECT of the present invention is to provide a training device for soccer for placement on a field and for allowing a soccer ball to be rebounded thereoff, kicked therethrough, and played therearound by a soccer player. The device includes a pair of identical supports for placement on a field and a plurality of planks that extend between the pair of supports. The pair of identical supports are inverted U-shaped. The plurality of planks include a plurality of top planks that extend longitudinally from one support to the other support, at their tops. The plurality of top planks are affixed to each support by top carriage bolts that depend through each top plank, through a respective support, and through top washers and threadably engage top nuts, with the plurality of top planks completely closing the training device for soccer, at its top. The plurality of planks further include a plurality of side planks that extend longitudinally from one support to the other support, at their sides. The plurality of side planks are affixed to each support by side carriage bolts that pass laterally through each side plank, through the respective support, and through side washers and threadably engage side nuts, with the plurality of side planks completely closing the training device for soccer, at both its sides, while leaving the training device for soccer completely open at its front, rear, and bottom.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
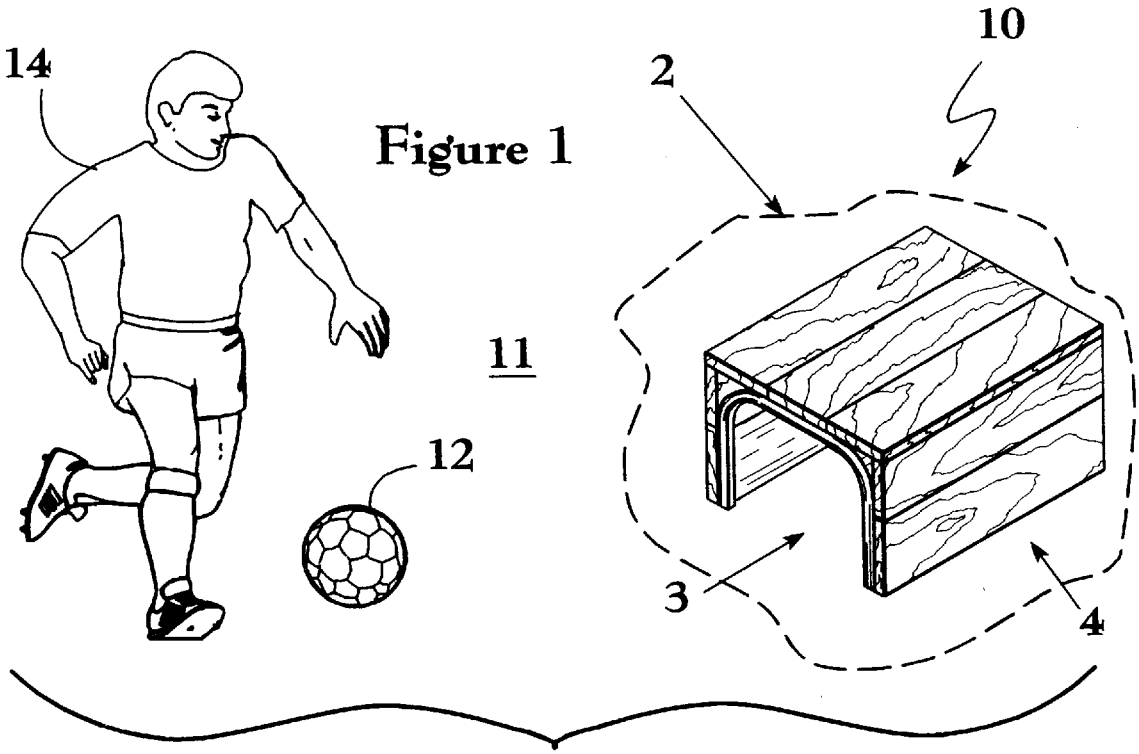
FIG. 1 is a diagrammatic perspective view of the present invention being utilized by a soccer player.

10 training device for soccer of the present invention
11 field
12 soccer ball
14 soccer player
16 pair of identical supports
18 pair of upright portions of each support of pair of identical supports 16
20 transverse portion of each support of pair of identical supports 16
22 plurality of throughbores in pair of upright portions of each support of pair of identical supports 16
24 plurality of throughbores in transverse portion 20 of each support of pair of identical supports 16
26 plurality of top planks
28 plurality of throughbores in each plank of plurality of top planks 26
30 top carriage bolts
32 top washers
34 top nuts
36 plurality of side planks
38 plurality of throughbores in each plank of plurality of side planks 36
40 side carriage bolts
42 side washers
44 side nuts

DETAILED DESCRIPTION OF THE PREFERRED EMBODIMENT

Referring now to the figures in which like numerals indicate like parts, and particularly to FIG. 1, the training device for soccer of the present invention is shown generally at 10 for placement on a field 11 and for allowing a soccer ball 12 to be rebounded thereoff, kicked therethrough, and played therearound by a soccer player 14.

Figure 3:
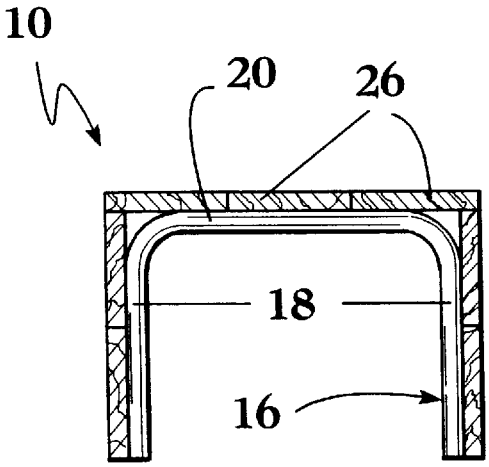
FIG. 3 is a diagrammatic front elevational view taken generally in the direction of arrow 3 in FIG. 1.
Figure 4:
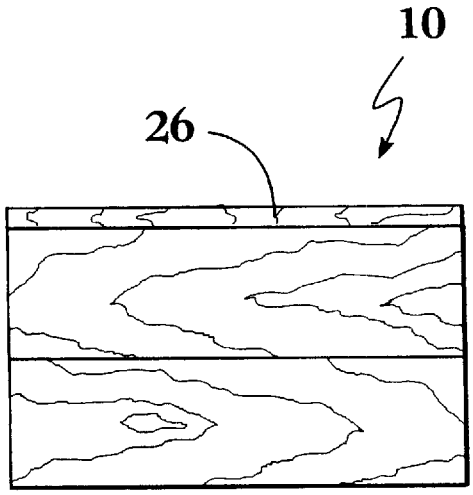
FIG. 4 is a diagrammatic side elevational view taken generally in the direction of arrow 4 in FIG. 1.
Figure 2:
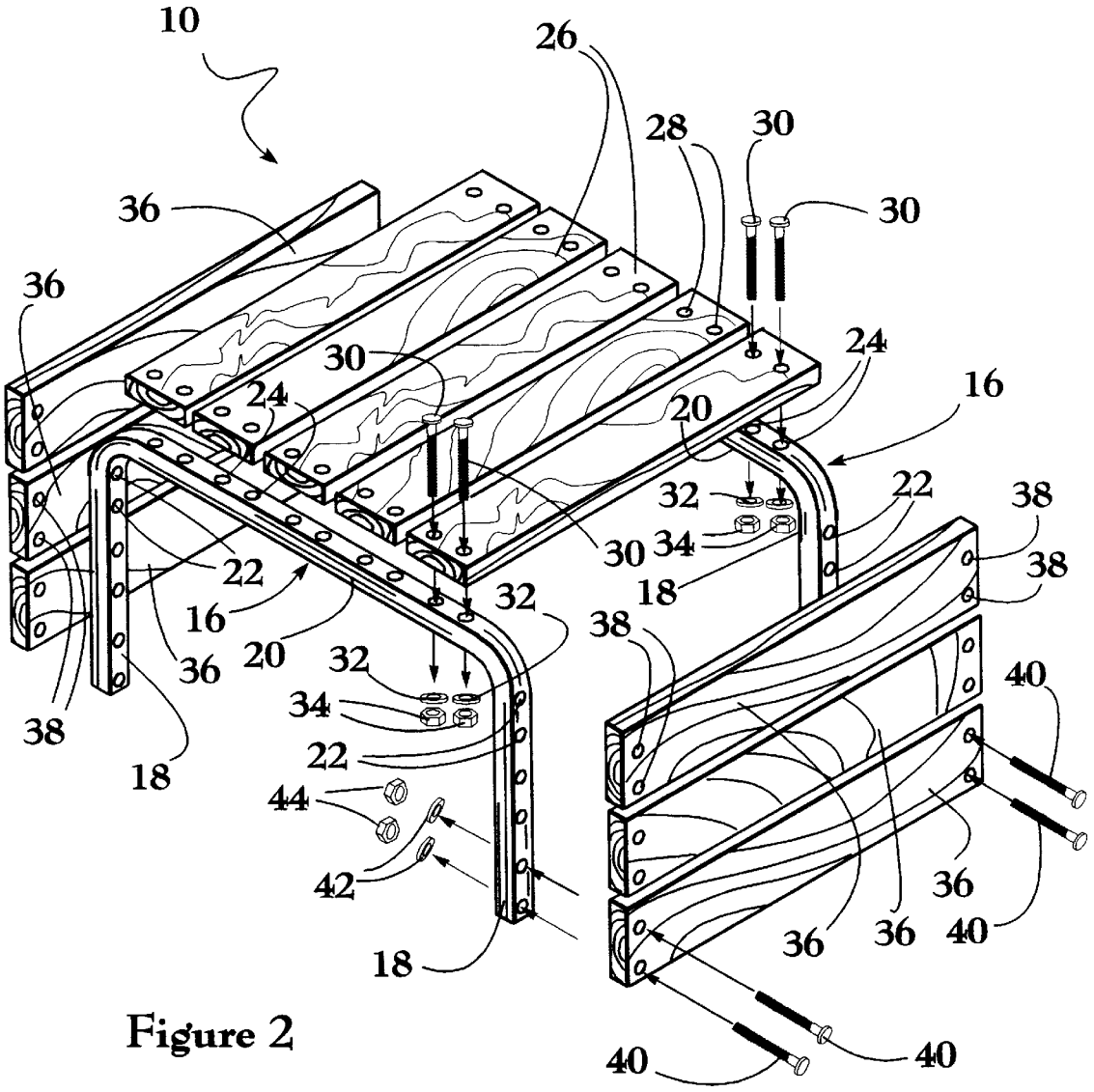
FIG. 2 is an exploded diagrammatic perspective view of the area generally enclosed by the dotted ellipse identified by arrow 2 in FIG. 1.

The configuration of the training deice for soccer 10 can best be seen in FIGS. 2–4, and as such will be discussed with reference thereto.

The training deice for soccer 10 comprises a pair of identical supports 16 for placement on the field 11 and which are tubular and inverted U-shaped, and are aligned, parallel, and longitudinally spaced-apart.

Each support of the pair of identical supports 16 has a pair of upright portions 18 for extending vertically upwardly from the field 11, and a transverse portion 20 that extends perpendicularly between, and integrally connects, the pair of upright portions 18, at their upper ends.

The pair of upright portions 18 of each support of the pair of identical supports 16 have a plurality of throughbores 22 therethrough that are aligned, laterally-oriented, and vertically spaced therealong.

The transverse portion 20 of each support of the pair of identical supports 16 has a plurality of throughbores 24 therethrough that are vertically-oriented, from top to bottom, and laterally spaced therealong.

The training device for soccer 10 further comprises a plurality of top planks 26 that are adjacent and extend longitudinally from the transverse portion 20 of one support of the pair of identical supports 16 to the transverse portion 20 of the other support of the pair of identical supports 16.

Each plank of the plurality of top planks 26 has a plurality of throughbores 28 therethrough, at each end thereof, that are vertically-oriented, from top to bottom, and laterally spaced therealong.

The plurality of top planks 26 are affixed to the transverse portion 20 of each support of the pair of identical supports 16 by top carriage bolts 30 that depend through the plurality of throughbores 28 in each plank of the plurality of top planks 26, through corresponding throughbores of the plurality of throughbores 24 in the transverse portion 20 of a respective support of the pair of identical supports 16, and through top washers 32 and threadably engage top nuts 34, with the plurality of top planks 26 completely closing the training device for soccer 10, at its top.

The training device for soccer 10 further comprises a plurality of side planks 36 that are adjacent and extend longitudinally from each upright portion of said pair of upright portions 18 of one support of the pair of identical supports 16 to aligned upright portions of said pair of upright portions 18 of the other support of the pair of identical supports 16.

Each plank of the plurality of side planks 36 has a plurality of throughbores 38 therethrough, at each end thereof, that are laterally-oriented and vertically spaced therealong.

The plurality of side planks 36 are affixed to the pair of upright portions 18 of each support of the pair of identical supports 16 by side carriage bolts 40 that pass laterally through the plurality of throughbores 38 in each plank of the plurality of side planks 36, through corresponding throughbores of the plurality of throughbores 22 in a respective upright portion of the pair of upright portions 18 of the respective support of the pair of identical supports 16, and through side washers 42 and threadably engage side nuts 44, with the plurality of side planks 36 completely closing the training device for soccer 10, at both its sides, while leaving the training device for soccer 10 completely open at its front, rear, and bottom.

It will be understood that each of the elements described above, or two or more together, may also find a useful application in other types of constructions differing from the types described above.

While the invention has been illustrated and described as embodied in a training device for soccer, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A training device for soccer for placement on a field and for allowing a soccer ball to be rebounded thereoff, kicked therethrough, and played therearound by a soccer player, said device comprising:

a) a pair of supports for placement on a field; and b) a plurality of planks extending between the pair of supports, wherein said pair of supports comprise a pair of identical supports that are tubular and inverted U-shaped, and are aligned, parallel, and longitudinally spaced-apart, wherein each support of said pair of identical supports has a pair of upright portions for extending vertically upwardly from the field, and a transverse portion that extends perpendicularly between, and integrally connects, said pair of upright portions, at their upper ends, wherein said transverse portion of each support of said pair of identical supports has a plurality of throughbores therethrough that are vertically-oriented, from top to bottom, and laterally spaced therealong, wherein said plurality of planks comprise a plurality of top planks have a plurality of throughbores therethrough and are adjacent and extend longitudinally from said transverse portion of one support of said pair of identical supports to said transverse portion of the other support of said pair of identical supports.

2. The device as defined in claim 1, wherein each plank of said plurality of top planks of said plurality of planks has a plurality of throughbores therethrough, at each end thereof, that are vertically-oriented, from top to bottom, and laterally spaced therealong.

3. The device as defined in claim 2, wherein said plurality of top planks of said plurality of planks are affixed to said transverse portion of each support of said pair of identical supports by top carriage bolts that depend through said plurality of throughbores in each plank of said plurality of top planks, through corresponding throughbores of said plurality of throughbores in said transverse portion of a respective support of said pair of identical supports, and through top washers and threadably engage top nuts, with said plurality of top planks completely closing said training device for soccer, at its top.

* * * * *